US009668534B2

(12) United States Patent
Normand

(10) Patent No.: US 9,668,534 B2
(45) Date of Patent: Jun. 6, 2017

(54) FOOTWEAR

(71) Applicant: SALOMON S.A.S., Metz-Tessy (FR)

(72) Inventor: Joseph Normand, Aix-les-Bains (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 14/501,695

(22) Filed: Sep. 30, 2014

(65) Prior Publication Data

US 2015/0096196 A1 Apr. 9, 2015

(30) Foreign Application Priority Data

Oct. 3, 2013 (FR) ..... 13/02298

(51) Int. Cl.

| | |
|---|---|
| ***A43B 3/00*** | (2006.01) |
| ***A43B 1/00*** | (2006.01) |
| ***A43B 5/00*** | (2006.01) |
| ***A43B 5/02*** | (2006.01) |
| ***A43B 5/10*** | (2006.01) |
| ***A43B 7/20*** | (2006.01) |
| ***A43B 19/00*** | (2006.01) |
| ***A43B 7/14*** | (2006.01) |

(52) U.S. Cl.

CPC ..... *A43B 3/0005* (2013.01); *A43B 1/0081* (2013.01); *A43B 5/00* (2013.01); *A43B 5/02* (2013.01); *A43B 5/10* (2013.01); *A43B 7/14* (2013.01); *A43B 7/20* (2013.01); *A43B 19/00* (2013.01)

(58) Field of Classification Search

CPC ..... A43B 7/20; A43B 3/0005; A43B 1/0081; A43B 19/00; A43B 7/14; A43B 5/10; A43B 5/00; A43B 5/02

USPC ..... 36/89, 88, 50.1

See application file for complete search history.

(56) References Cited

U.S. PATENT DOCUMENTS

| | | | | | |
|---|---|---|---|---|---|
| 4,621,648 | A | * | 11/1986 | Ivany | 602/27 |
| 4,864,741 | A | | 9/1989 | Beauchemin | |
| 4,878,504 | A | * | 11/1989 | Nelson | 602/27 |
| 5,016,623 | A | | 5/1991 | Krahenbuhl | |
| 5,291,671 | A | * | 3/1994 | Caberlotto et al. | 36/88 |
| 5,499,461 | A | * | 3/1996 | Danezin et al. | 36/117.2 |
| 5,588,228 | A | * | 12/1996 | Foscaro et al. | 36/118.2 |
| 5,701,689 | A | * | 12/1997 | Hansen et al. | 36/115 |
| 5,771,608 | A | * | 6/1998 | Peterson | 36/89 |

(Continued)

FOREIGN PATENT DOCUMENTS

| | | |
|---|---|---|
| EP | 0 748 596 A1 | 12/1996 |
| GB | 2 162 755 A | 2/1986 |

*Primary Examiner* — Shaun R Hurley

*Assistant Examiner* — Bao-Thieu L Nguyen

(74) *Attorney, Agent, or Firm* — Greenblum & Bernstein, P.L.C.

(57) ABSTRACT

A shoe including a sole assembly; an upper including a first envelope that includes a lower portion designed to surround the foot of a user; and an upper portion designed to surround the ankle or the ankle and a portion of the lower leg of the user; and an information transmission band that includes a first portion affixed to the sole assembly and/or the lower portion of the first envelope by a connection device, such as stitches; and a second portion designed to wrap around the upper portion of the first envelope, extending the first portion and including a first fastening device that cooperates with a second fastening device affixed to the upper portion of the first envelope.

17 Claims, 5 Drawing Sheets

(56) References Cited

U.S. PATENT DOCUMENTS

| | | | | |
|---|---|---|---|---|
| 5,822,887 | A * | 10/1998 | Turner | 36/89 |
| 5,894,684 | A * | 4/1999 | Sand et al. | 36/117.1 |
| 6,272,772 | B1 * | 8/2001 | Sherman | 36/89 |
| 6,652,474 | B1 * | 11/2003 | Quinn | A61F 5/0111 128/882 |
| 7,380,354 | B2 * | 6/2008 | Yamashita | A43B 5/00 36/50.1 |
| 8,302,329 | B2 | 11/2012 | Hurd et al. | |
| 2005/0198869 | A1 * | 9/2005 | Bouche et al. | 36/89 |
| 2009/0071037 | A1 * | 3/2009 | Foxen et al. | 36/89 |
| 2011/0119956 | A1 | 5/2011 | Borel et al. | |
| 2011/0308110 | A1 * | 12/2011 | Berns et al. | 36/89 |
| 2014/0223775 | A1 * | 8/2014 | Fleuren | 36/89 |

* cited by examiner

FOOTWEAR

CROSS-REFERENCE TO RELATED APPLICATION

This application is based upon French Patent Application No. 13/02298, filed Oct. 3, 2013, the disclosure of which is hereby incorporated by reference thereto in its entirety, and the priority of which is claimed under 35 U.S.C. §119.

BACKGROUND

1. Field of the Invention

The invention relates to an article of footwear, such as a shoe, in particular a sports shoe.

A shoe of the aforementioned type may be used in particular for sports such as tennis, badminton, volleyball, soccer, baseball, basketball, or boxing, as well as for other activities. The aforementioned sports in particular involve a risk of ankle injuries, such as sprains, for example.

2. Background Information

U.S. Pat. No. 8,302,329-B1 discloses a basketball shoe equipped with a counter-supplementing strap anchored on the lateral side of the shoe and surrounding the rear portion of the shoe. This strap is attached to the front of the foot with laces. The counter-supplementing strap enables the rear portion of the shoe to support and stabilize the foot during lateral movements of the foot.

The counter-supplementing strap minimizes ankle sprains by opposing the inversion movement of the foot, which brings the plantar surface inwards, that is to say, medially, by lifting the medial edge of the foot. At the start of a foot inversion movement, the aforementioned action of the counter-supplementing strap does not prevent such movement from amplifying and bringing the foot in a position likely to cause injury to the ankle. When the ankle twists severely, the counter-supplementing strap is not sufficiently effective to prevent the ankle from twisting.

SUMMARY

The aforementioned drawbacks are ones that the invention more particularly remedies, by providing a shoe that makes it possible to prevent the occurrence of ankle injuries. The invention also improves proprioception, thereby enabling a user to better perceive the sensory information transmitted from the ground to the foot, ankle, or lower leg. This makes the interactions between the ground and the shoe more perceptible.

To this end, the invention relates to a shoe comprising:

a sole assembly;

an upper comprising a first envelope including:

- a lower portion provided to surround the foot of a user; and
- an upper portion provided to surround the ankle, or the ankle and a portion of the lower leg of the user.

The shoe includes an information transmission band comprising:

- a first portion affixed to the sole assembly and/or to the lower portion of the first envelope by a connection device extending along the first portion; and
- a second portion designed to wrap around the upper portion of the first envelope, extending the first portion and comprising a first fastening device designed to cooperate with a second fastening device affixed to the upper portion of the first envelope.

As described below, in exemplary embodiments, the first portion of the band extends on the lateral side of the shoe.

As a result of the invention, when the user's foot begins an inversion movement, the user receives information on the position of his ankle via the band. The user automatically corrects his or her movement to prevent amplification of the inversion movement. In this way, the band preemptively avoids ankle injuries, in particular sprains; that is, the user proactively corrects his or her movement before the injury is initiated.

According to advantageous but not essential aspects of the invention, a shoe of this type may incorporate one or more of the following features, taken in any technically feasible combination:

- The second portion of the band is movable between a first position, in which the second portion of the band is not fastened to the first envelope, and a second position, in which the second portion of the band at least partially surrounds the upper portion the first envelope.
- In the second position, the first fastening device cooperate with the second fastening device
- In the second position, the second portion of the band forms a circular arc portion having an angle greater than 180° or, in other embodiments, an angle greater than 270°.
- In the second position, the band extends on the lateral side of the shoe, beyond a longitudinal median plane of the shoe.
- The band is less elastic than the first envelope.
- The fastening devices are constituted by hook-and-loop fasteners, such VELCRO® fasteners.
- A first end of the band is attached in the area of junction between the upper and the sole assembly, for example by means of stitching or gluing or other attachment expedient.
- A first end of the first portion of the band is attached on the lateral side of the boot, in the area of a metatarsal zone of the shoe provided to receive the metatarsals of the user's foot, the zone extending, along a longitudinal axis of the shoe, between a first boundary and a second boundary located at a first distance and a second distance, respectively, from the heel of the shoe. The first distance is greater than or equal to 60% of the total length of the shoe. The second distance is less than or equal to 85% of the total length of the shoe, the first distance being strictly less than the second distance.
- The upper further comprises an outer envelope, and the first envelope is housed within the outer envelope and demarcates an inner volume of the shoe.
- The first envelope forms an outer envelope of the upper demarcating an inner volume of the shoe.

BRIEF DESCRIPTION OF DRAWINGS

The invention and its advantages will be better understood upon reading the following description of two embodiments of a shoe according to the invention, given solely by way of examples, and with reference to the annexed drawings, in which.

DETAILED DESCRIPTION

Figure 1:
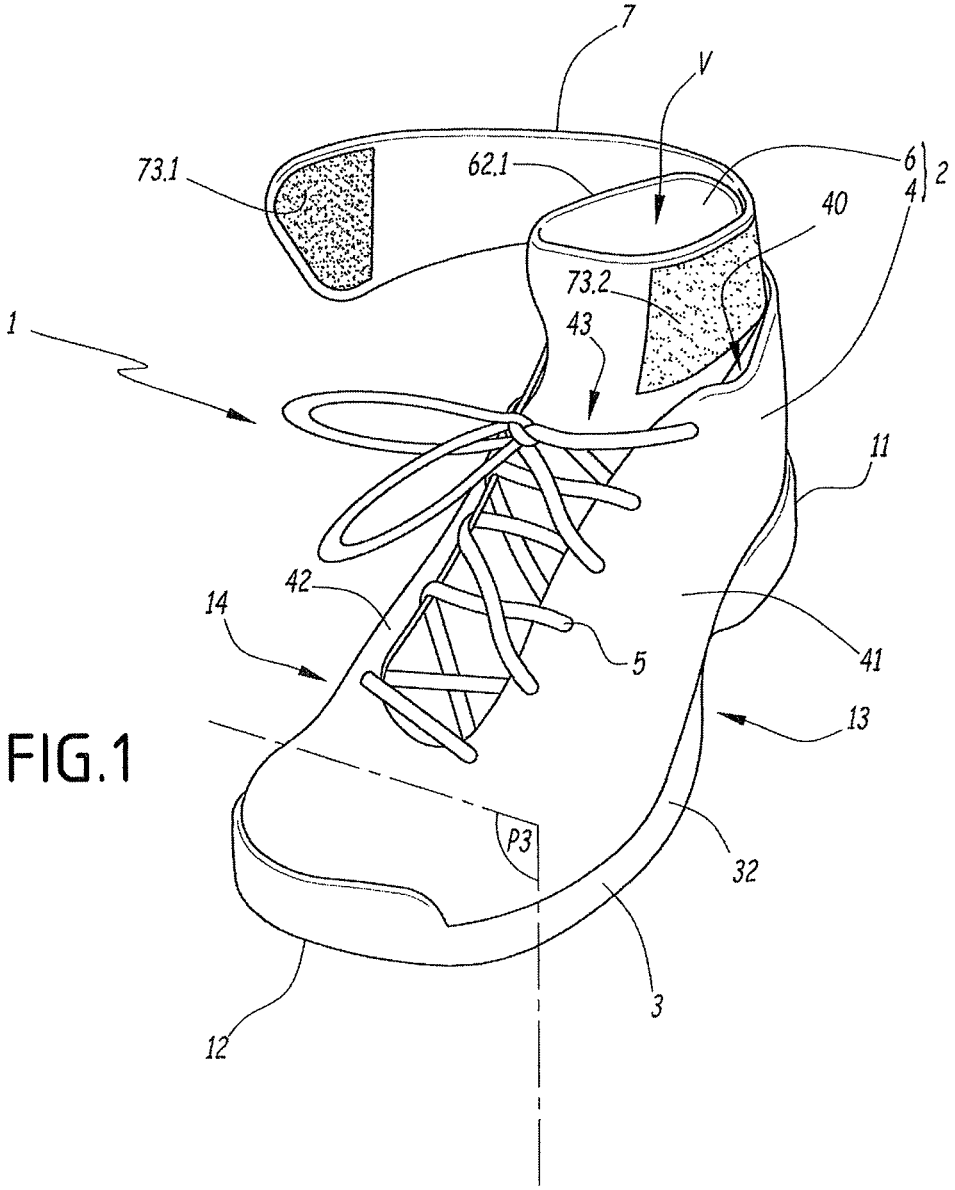
FIG. 1 is a perspective view of a shoe according to the invention.
Figure 2:
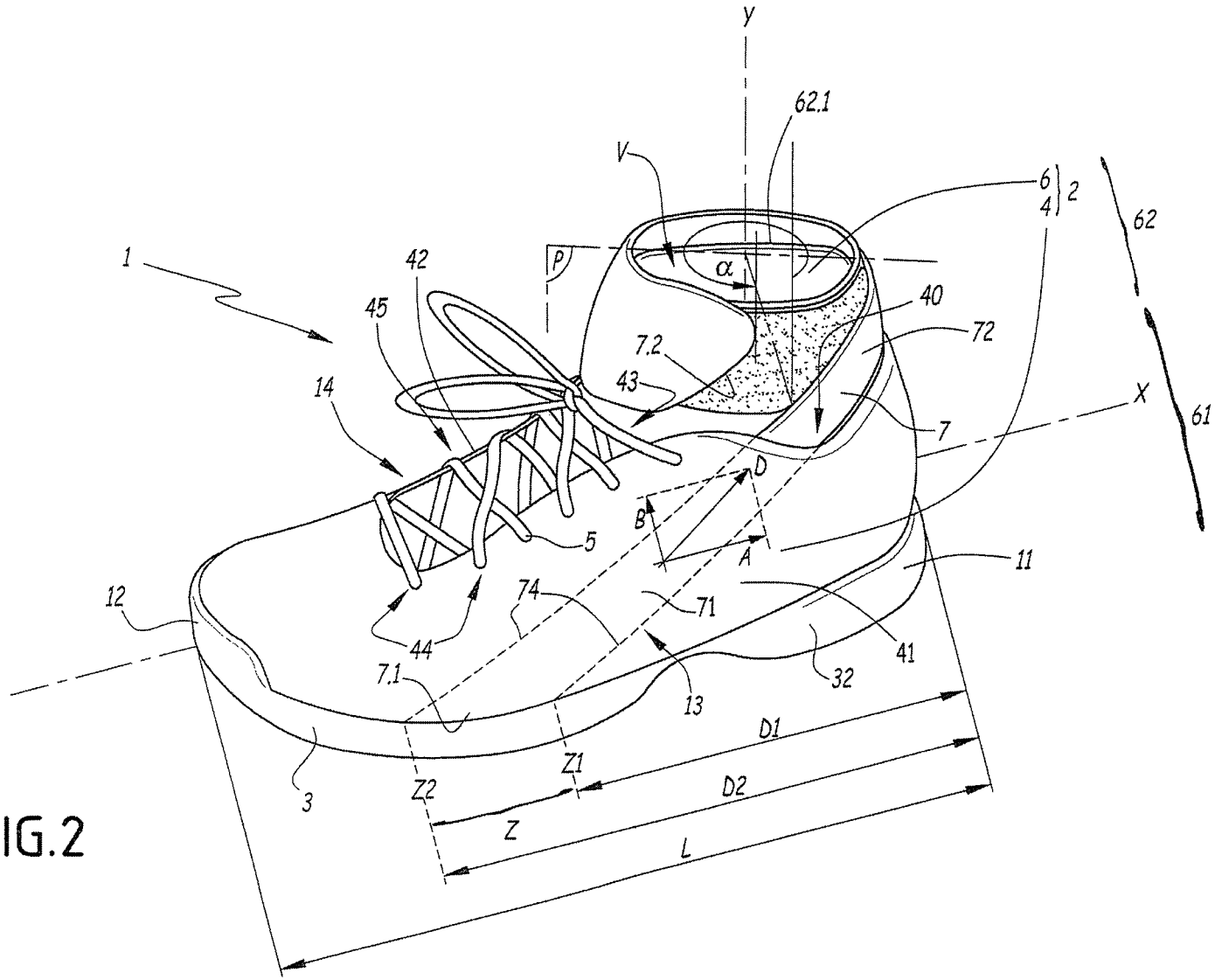
FIG. 2 is a perspective view, from another angle, of the shoe of FIG. 1.
Figure 3:
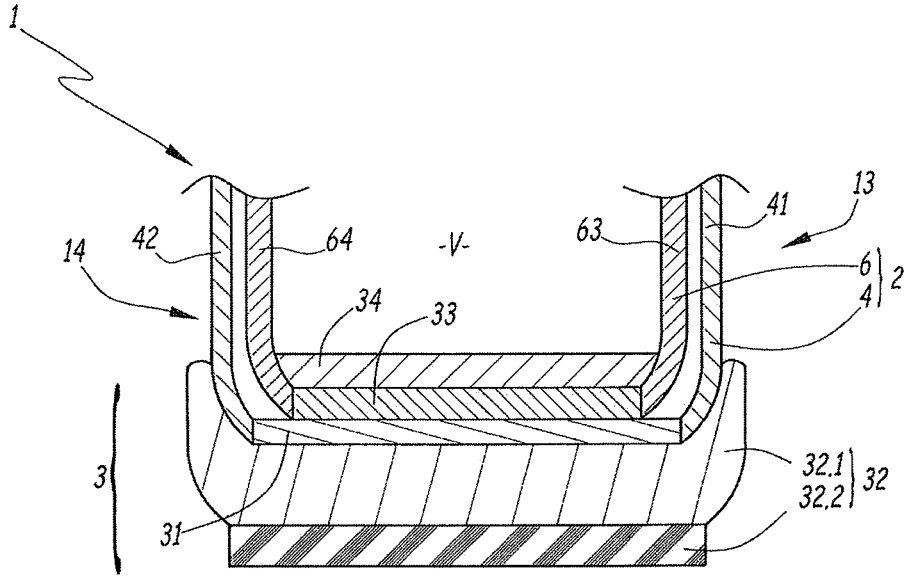
FIG. 3 is a partial cross section along the plane P3 in FIG. 1.

FIGS. 1 to 3 show a shoe 1 provided to receive the foot of a user. The shoe 1 is designed for sporting activities, in particular tennis, basketball, or boxing. The invention is also applicable to other types of footwear.

The shoe 1 extends lengthwise between a heel 11 and a front end 12, and widthwise between a lateral side 13 and a medial side 14.

A longitudinal axis X of the shoe 1 extends between the heel 11 and the front end 12.

The shoe 1 comprises an upper 2 designed to surround the user's foot, and a sole assembly 3 comprising a plurality of layers 31, 32, 33, and 34 (see FIG. 3, for example).

The upper 2 demarcates a volume V for receiving the user's foot, and comprises an outer envelope 4 and an inner liner 6, or first envelope, housed within the outer envelope 4. Accordingly, volume V can be considered a "foot-receiving" volume.

In the present description, the terms inner and outer are related to the volume V, that is, the foot-receiving volume. An inner element demarcates the volume V, and an outer element is located outside of the volume V. However, the outer element itself, that is, the outer envelope 4, can be considered a "first-envelope-receiving" volume for receiving the first envelope, that is, a "volume" for receiving the inner liner 6.

The outer envelope 4 of the upper 2 comprises a lateral quarter 41 and a medial quarter 42 affixed by their base to a first lasting board 31, for example by means of stitching, in particular Strobel® stitching. See, for example, FIG. 3 in which the ends of the quarters 41, 42 are shown in abutting contact with the lasting board 31. Strobel® stitching provides greater flexibility and strength than at least many other types of construction. In a particular embodiment, the Strobel® stitching does not extend into the outsole 32 that is beneath the outer envelope 4.

The outer envelope 4 of the upper 2 is affixed to an outsole 32, for example by gluing. In a particular embodiment, the upper is affixed to the outsole 32 only by means of an adhesive, such as glue or cement. The outsole 32 includes a midsole 32.1 and a wear layer 32.2.

The outer envelope 4 of the upper 2 is low, that is to say, it is designed to cover only the foot of the user, and not the lower leg. Thus, the lateral quarter 41 and medial quarter 42 of the outer envelope 4 each comprises a notch 40, or depression, designed to extend around the malleolus of the user.

The outer envelope 4 comprises an opening 43 extending between the lateral quarter 41 and the medial quarter 42, and designed to enable the user to put on the shoe 1.

A tightening arrangement is provided for reversibly tightening the upper 2 on the foot of the user. The tightening arrangement comprises holes 44 and 45 provided in the outer envelope 4 of the upper 2, along the opening 43. The holes 44 are arranged on the lateral side 13 and the holes 45 are arranged on the medial side 14.

The tightening arrangement also includes a lace 5 winding through the holes 44 and 45. A tensioning of the lace 5 enables a tightening of the upper 2 by bringing the lateral quarter 41 and medial quarter 42 of the outer envelope 4 of the upper 2 closer to one another.

Alternatively, the holes 44 and 45 and/or the lace 5 may be replaced with other tightening arrangements, such as one that includes hooks, for example.

The inner liner 6 includes a lower portion 61 covered by the outer envelope 4 and designed to surround the foot of the user, as well as a generally tubular upper portion 62 designed to surround the lower leg, and particularly to cover the malleoli. Thus, the upper portion 62 projects beyond the outer envelope 4.

The lower portion 61 comprises a lateral quarter 63 and a medial quarter 64 affixed by their base to a second lasting board 33, for example by means of stitching, in particular Strobel® stitching.

Optionally, an insole 34 is arranged within the volume V, above the second lasting board 33.

The free end 62.1 of the upper portion 62 defines an opening for passage of the foot of the user, when putting on the shoe 1. When the foot is in place inside the shoe 1, the upper portion 62 surrounds the lower leg and the ankle.

An information transmission band 7 includes a first end 7.1 attached in the area of the junction between the upper 2 and the outer sole assembly 3, for example by means of stitching or gluing. The first end 7.1 is located on the lateral side 13 of the shoe, in the area of a zone Z of the shoe 1 designed to receive the metatarsals of the foot of the user.

The zone Z extends along the axis X, between a first boundary Z1 and a second boundary Z2. The first boundary Z1 is located at a distance D1 from the heel 11, measured parallel to the axis X, from the heel 11, which is greater than or equal to 60% of the total length L of the shoe 1, measured parallel to the axis X, between the heel 11 and the front end 12. The second boundary Z2 is located at a distance D2 from the heel 11, measured parallel to the axis X, from the heel 11, which is less than or equal to 85% of the total length L of the shoe 1. Alternatively, a distance D2 less than or equal to 75% may be provided.

The distance D1 is strictly less than the distance D2.

The zone Z is an anchoring zone for the first end 7.1 of the band 7, that is to say, the first end 7.1 of the band 7 is included in the zone Z. Thus, the width of the band 7, in the area of the first end 7.1, is less than or equal to the length D2-D1 of the zone Z.

The band 7 comprises a first portion 71 extending from the first end 7.1 and located between the outer envelope 4 and the inner liner 6 of the upper 2. The first portion 71 is attached to the inner liner 6 by a connection device extending along the first portion 71, for example by means of stitches 74.

The first portion 71 is concealed beneath the outer envelope 4 and extends along a direction D, which includes an axial component A parallel to the axis X that extends in a direction extending from the front end 12 to the heel 11. The direction D also comprises a component B parallel to an axis Y generally perpendicular to the plane of the sole assembly 3. The axis Y is generally parallel to the leg of the user when the shoe is being worn. The component B is directed upwardly along the axis Y when the shoe 1 rests on a horizontal surface.

The band 7 comprises a second portion 72 extending the first portion 71, outside of the outer envelope 4, and which is not attached to the upper 2. As can be seen in FIG. 2, the upper edge of outer envelope, in this case the upper edge of the notch 40, extends over the band 7. That is, the band does not extend over the outer surface of the outer envelope 4. The second portion 72 of the band 7 is designed to wrap around the upper portion 62 of the inner liner 6, so as to tighten the upper portion 62 and the lower leg of the user. The second portion 72 ends with a free end 7.2 opposite to the first end 7.1.

As shown in FIG. 1, the inner surface of the second portion 72 is provided on the side of the free end with the first fastening device 73.1, such as the hooks of a hook-and-loop fastener, or Velcro®, designed to hook on a second fastening device 73.2 affixed to the inner liner 6, such as the loops of a second hook-and-loop fastener, the hooks and loops being structurally complementary.

The outer envelope 4 of the upper 2 is made from a relatively flexible material, such as a layer or a superposition of several layers, which may be made of natural or synthetic material. In a non-limiting manner, a layer can be made of leather, a sheet of polyurethane or similar material, threads assembled to one another mechanically, or the like.

The inner liner 6 is made from a slightly and relatively elastic material, for example comprising threads of synthetic material assembled to one another mechanically, using techniques such as weaving, knitting, or other technique, so as to follow the movements of the foot and ankle.

The band 7 is made from a flexible and inextensible material, for example a braided or woven strap, a band of synthetic material, or the like. Alternatively, the band 7 is slightly extensible, thereby providing better comfort to the user. In any case, the band 7 is less elastic than the inner liner 6 to which it is attached.

The operation is as follows. The user detaches the free end 7.2 of the band 7 from the second fastening device 73.2 and then inserts his or her foot into the inner liner 6, in the area of the free end. Once the foot is in place inside the inner liner 6, the user grabs the free end 7.2 of the band 7 to wrap it around the upper portion 62 of the inner liner 6, so as to tighten the ankle and the lower leg. Then, the user makes the first and second fastening devices 73.1, 73.2 cooperate with one another, for example by exerting pressure on the first fastening device.

Thus, the band 7 is movable between a first position, shown in FIG. 1, in which the free end 7.2 of the band 7 is not fastened to the inner liner 6, and a second position, shown in FIG. 2, in which the band 7 at least partially surrounds the upper portion 62 of the inner liner 6, from a first side of the shoe to a second side of the shoe, the end of the band 7 being fastened over the upper portion 62 of the inner liner. As shown in FIG. 2, the end of the band 7 is fastened in place over the first side of the shoe, which is the lateral side in the exemplary embodiment shown in FIG. 2.

In the second position, the second portion 72 of the band 7 forms a circular arc portion, about the axis Y, having angle $\alpha$ greater than 180° or, in another embodiment, greater than 270°.

In the second position, the band 7 extends on the lateral side of the shoe 1, beyond a longitudinal median plane P of the shoe, which passes through the axis X and divides the shoe 1 into a lateral portion and a medial portion.

During use of the shoe 1, for example for playing tennis, when the foot of the user begins an inversion movement, the band 7, which is slightly elastic or not elastic, is mechanically biased by the foot of the user. This mechanical stress is transmitted to the ankle and lower leg through the band 7. Thus, the user receives information on the position of his ankle via the band 7. The user can automatically correct his or her movement to prevent amplification of the inversion movement. In this way, the band 7 preemptively prevents ankle injuries, particularly sprains; that is, the user proactively corrects his or her movement before the injury is initiated.

Figure 6:
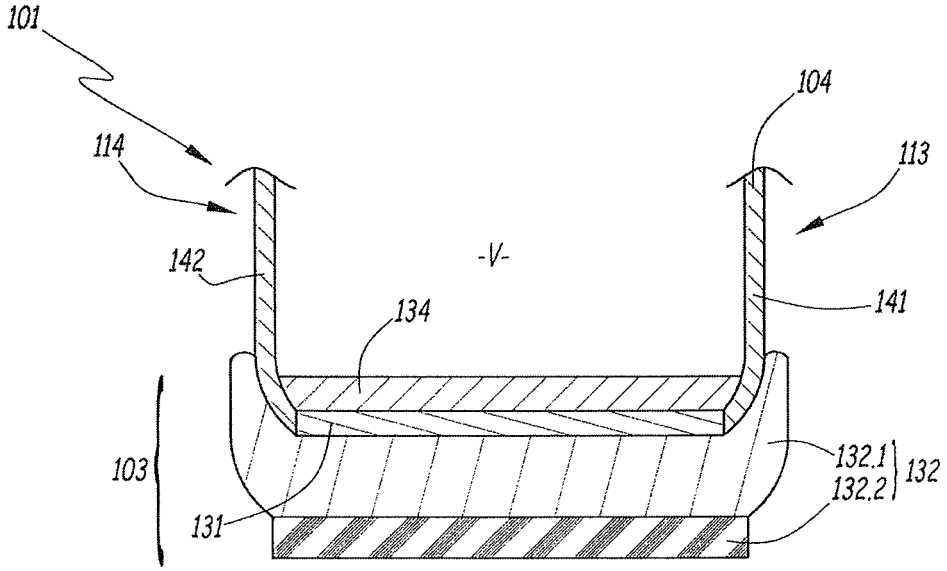
FIGS. 4 to 6 are views, similar to FIGS. 1 to 3, of a shoe according to a second embodiment of the invention.
Figure 4:
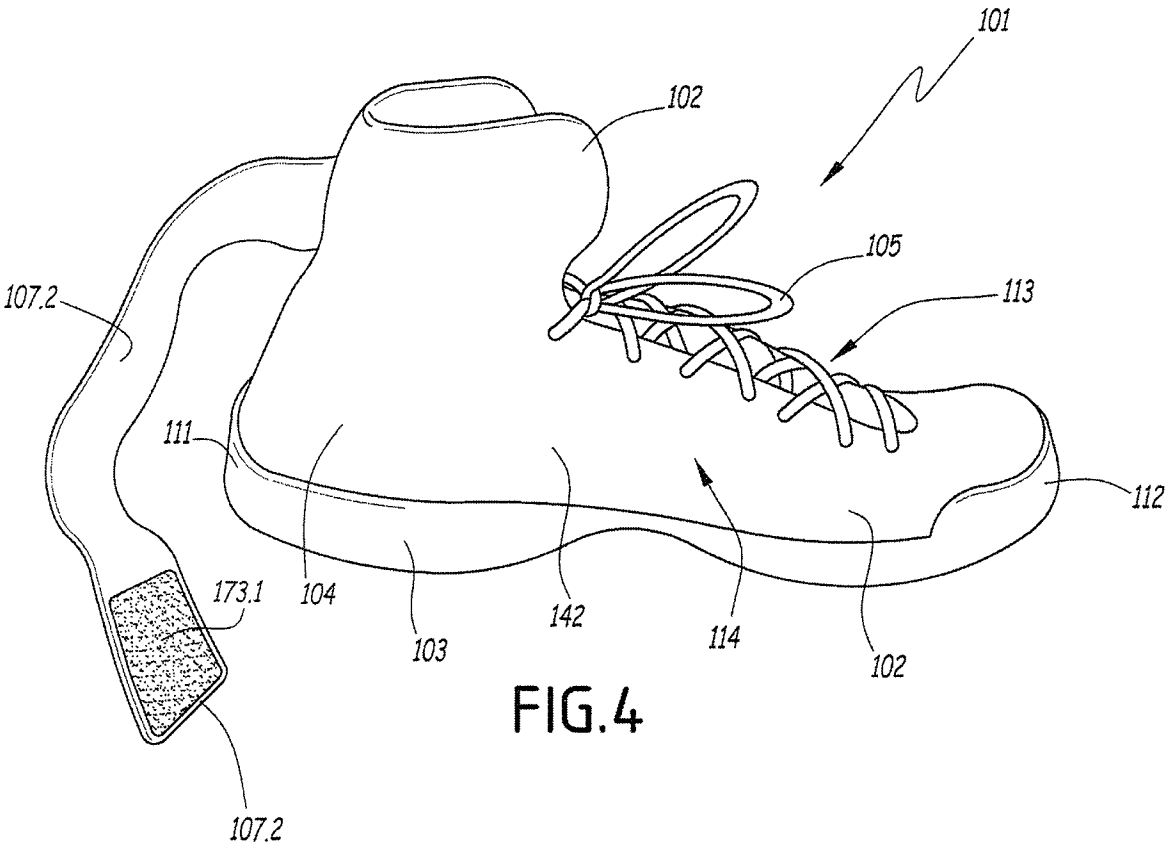
Figure 5:
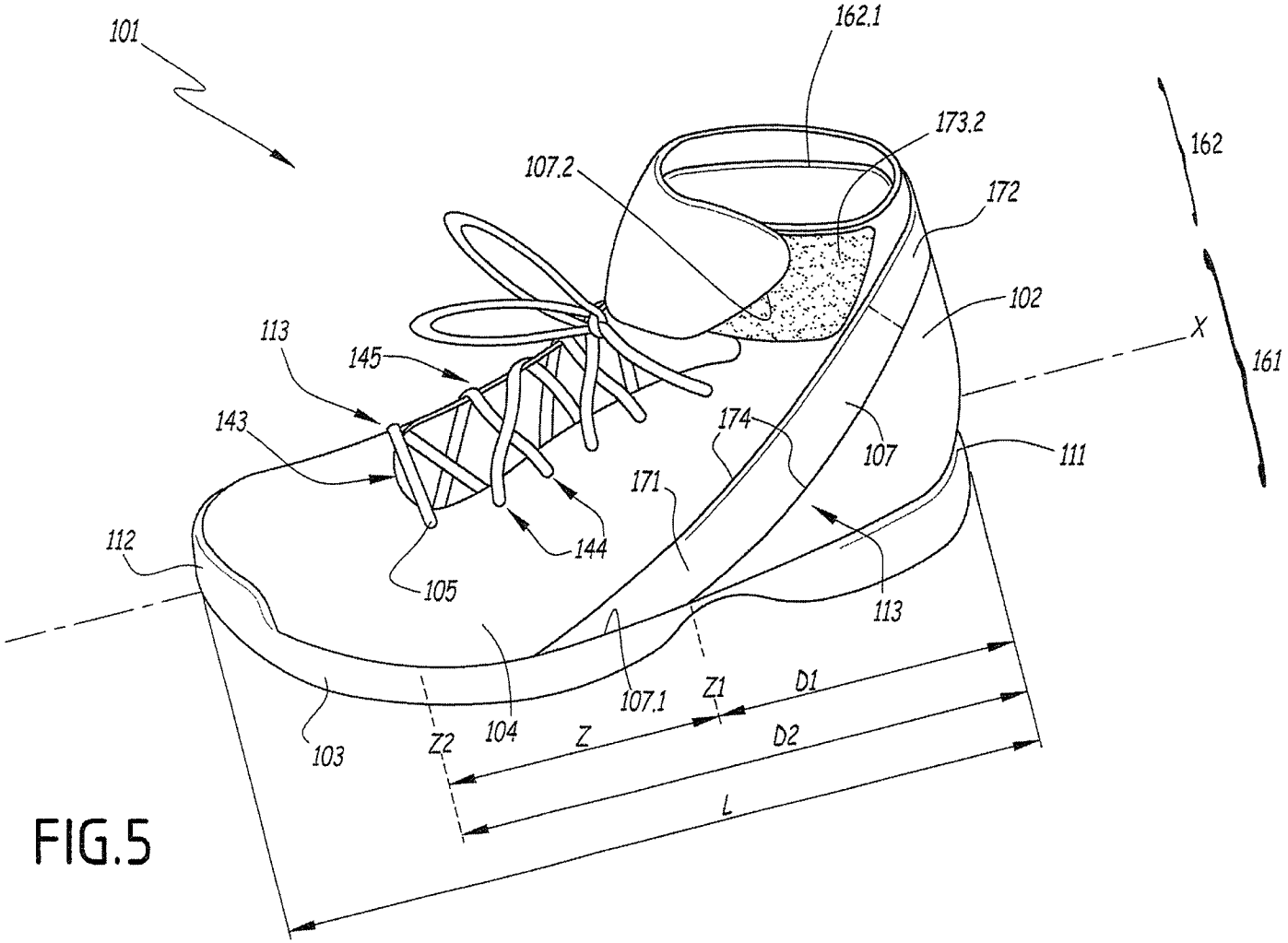

FIGS. 4 to 6 show a shoe 101 according to a second embodiment of the invention. In FIGS. 4 to 6, the elements similar to those of FIGS. 1 to 3 bear the same reference numerals, increased by 100.

Hereinafter, the elements of the shoe 101 similar to those of the shoe 1 are not described in detail.

The shoe 101 extends lengthwise between a heel 111 and a front end 112, and widthwise between a lateral side 113 and a medial side 114. It has a longitudinal axis X.

The shoe 101 comprises an upper 102 designed to surround the user's foot, and a sole assembly 103 including a plurality of soles 131, 132, and 134.

The upper 102 demarcates a volume V for receiving the foot of a user, and comprises an outer envelope 104 or first envelope.

Unlike the shoe 1, the shoe 101 comprises no inner liner housed within the outer envelope 104.

The outer envelope 104 of the upper 102 includes a lateral quarter 141 and a medial quarter 142 affixed by their base to a first lasting board 131, for example by means of stitching, such as by means of Strobel® stitching.

The outer envelope 104 of the upper 102 is affixed to an outsole 132, for example by gluing. The outsole 132 includes a midsole 132.1 and a wear layer 132.2.

The outer envelope 104 of the upper 102 includes a lower portion 161 designed to surround the foot of the user, and a generally tubular upper portion 162 designed to surround the lower leg, and particularly to cover the malleoli.

Optionally, an insole 134 is arranged within the volume V, above the first lasting board 131.

The free end 162.1 of the upper portion 162 defines an opening for passage of the foot of the user, when putting on the shoe 101. When the foot is in place within the shoe 1, the upper portion 162 surrounds the lower leg.

The outer envelope 104 comprises an opening 143 extending between the lateral quarter 141 and the medial quarter 142 and provided to enable the user to put on the shoe 101.

A tightening arrangement 105, 144, and 145 is provided to reversibly tighten the upper 102 of the foot of the user.

An information transmission band 107 includes a first end 107.1 attached in the area of the junction between the upper 102 and sole assembly 103, for example by means of stitching or gluing. The first end 107.1 is located on the lateral side 113 of the shoe, in the area of a zone Z1 of the shoe 1 designed to receive the metatarsals of the foot of the user and similar to the zone Z described with reference to the first embodiment.

The band 107 includes a first portion 171 extending from the first end 107.1 and attached to the lower portion 161 of the upper 102, for example by means of stitches 174 extending along the first portion, in the area of the anchoring zone Z.

The band 107 includes a second portion 172 extending the first portion 171 and designed to wrap around the upper portion 162, so as to tighten the upper portion 162 and the lower leg of the user. The second portion 172 ends with a free end 107.2, opposite the first end 107.1.

The inner surface of the second portion 172 is provided, on the side of the free end, with a first fastening device 173.1 designed to hook on the second fastening device 173.2 affixed to the upper portion 162 of the upper 102.

The outer envelope 4 of the upper 2 is made from a relatively flexible and slightly elastic material containing one or more layers of natural or synthetic materials such as leather, fabric, a sheet of plastic material, so as to follow the movements of the foot and ankle.

The band 107 is made from a flexible and inextensible material, for example a textile strap or any equivalent. Alternatively, the band 107 is slightly extensible, thereby providing better comfort to the user. In any case, the band 107 is less elastic than the outer envelope 104 to which it is attached.

The operation is similar to that of the shoe 1. The user detaches the free end 107.2 of the band 107 from the second fastening device, and then inserts his or her foot in the upper portion 162 of the upper 102, in the area of the free end 162.1. Once the foot is in place in the outer envelope 104, the user grabs the free end 107.2 of the band 107 to wrap it around the upper portion 162 of the outer envelope 104, so as to tighten his or her ankle and lower leg. Then, the user makes the first and second fastening devices cooperate with one another.

Thus, the band 107 is movable between a first position, shown in FIG. 4, in which the free end 107.2 of the band 107 is not fastened to the upper 102, and a second position, shown in FIG. 5, in which the band 107 at least partially surrounds the upper portion 162 of the upper 102 and is fastened to the upper portion 162.

In the context of the invention, the alternative embodiments described above may be combined with one another, at least partially.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A shoe comprising:
a sole assembly;
an upper comprising:
a first envelope comprising:
a lower portion designed to surround a foot of a user;
an upper portion designed to surround an ankle of the user, or to surround the ankle and a portion of a lower leg of the user;
an outer envelope;
the first envelope being housed within the outer envelope and demarcating an inner foot-receiving volume of the shoe, the outer envelope demarcating a first-envelope-receiving volume;
an information transmission band comprising:
a first portion extending on a first side of the shoe upwardly and rearwardly within the first-envelope-receiving volume and between the first envelope and the outer envelope and being affixed, with stitches or glue, to one of the following:
the sole assembly; or
the lower portion of the first envelope; or
both the sole assembly and the lower portion of the first envelope;
a second portion extending from the first portion and extending outside of the outer envelope on the first side of the shoe, the second portion being designed to wrap around a rear of the upper portion of the first envelope from the first side of the shoe to a second side of the shoe, the second portion comprising a first fastening device designed to cooperate with a second fastening device configured to fix the second portion of the information transmission band in place in relation to the upper portion of the first envelope;
an upper edge of the outer envelope extending over the information transmission band on the first side of the shoe.

2. A shoe according to claim 1, wherein:
the first side of the shoe is a lateral side of the shoe and the second side of the shoe is a medial side of the shoe.

3. A shoe according to claim 1, wherein:
the second portion of the band is movable between a first position in which the second portion of the band is not fastened to the first envelope, and a second position in which the second portion of the band at least partially surrounds the upper portion of the first envelope.

4. A shoe according to claim 3, wherein:
in the second position, the first fastening device cooperates with the second fastening device.

5. A shoe according to claim 3, wherein:
in the second position, the second portion of the band forms a circular arc portion having an angle greater than 180°.

6. A shoe according to claim 3, wherein:
in the second position, the second portion of the band forms a circular arc portion having an angle greater than 270°.

7. A shoe according to claim 3, wherein:
in the second position, the band extends on the lateral side of the shoe and beyond a longitudinal median plane of the shoe.

8. A shoe according to claim 1, wherein:
the band is less elastic than the first envelope.

9. A shoe according to claim 1, wherein:
the first and second fastening devices comprise hook-and-loop fasteners.

10. A shoe according to claim 1, wherein:
a first end of the band is attached in an area of a junction between the upper and the sole assembly by means of stitches or glue.

11. A shoe according to claim 1, wherein:
a first end of the first portion of the band is attached on the lateral side of the shoe in an area of a zone of the shoe designed to receive the metatarsals of the foot of the user, the zone extending along a longitudinal axis of the shoe between a first boundary and a second boundary located at a first distance and a second distance, respectively, from a heel of the shoe;
the first distance is greater than or equal to 60% of the total length of the shoe; and
the second distance is less than or equal to 85% of the total length of the shoe, the first distance being less than the second distance.

12. A shoe according to claim 1, wherein:
the first fastening device of the second portion of the information transmission band is releasably engageable with the second fastening device.

13. A shoe according to claim 12, wherein:
the first and second fastening devices comprise complementary hook-and-loop fasteners.

14. A shoe according to claim 1, wherein:
the outer envelope comprises a lateral quarter and a medial quarter;
the upper further includes a foot-tightening arrangement affixed to the lateral and medial quarters of the outer envelope designed to bring lateral and medial quarters closer to one another;
no foot-tightening arrangement is affixed to the first envelope.

15. A shoe according to claim 1, wherein:

the lower portion of the first envelope comprises a lateral quarter and a medial quarter affixed by respective bases to a lasting board with Strobel stitching.

16. A shoe according to claim 1, wherein:

the second fastening device is configured to be affixed to the upper portion of the first envelope.

17. A shoe according to claim 1, wherein:

the second fastening device is configured to be affixed to the upper portion of the first envelope on the first side of the shoe.

* * * * *